US007789534B2

(12) United States Patent
Wang

(10) Patent No.: US 7,789,534 B2
(45) Date of Patent: Sep. 7, 2010

(54) LED LAMP WITH HEAT DISSIPATION MECHANISM AND MULTIPLE LIGHT EMITTING FACES

(75) Inventor: Pei-Choa Wang, Gueishan Township, Taoyuan County (TW)

(73) Assignee: Pyroswift Holding Co., Limited., Hong Kong (HK)

( * ) Notice: Subject to any disclaimer, the term of this patent is extended or adjusted under 35 U.S.C. 154(b) by 386 days.

(21) Appl. No.: 12/103,224

(22) Filed: Apr. 15, 2008

(65) Prior Publication Data

US 2008/0212325 A1 Sep. 4, 2008

Related U.S. Application Data

(63) Continuation-in-part of application No. 11/393,816, filed on Mar. 31, 2006, now abandoned.

(51) Int. Cl.
*F21V 29/00* (2006.01)

(52) U.S. Cl. ..... 362/294; 362/249.02

(58) Field of Classification Search ..... 362/294.02, 362/294
See application file for complete search history.

(56) References Cited

U.S. PATENT DOCUMENTS

| | | | | |
|---|---|---|---|---|
| 7,543,960 | B2 * | 6/2009 | Chang et al. | 362/294 |
| 2007/0236935 | A1 * | 10/2007 | Wang | 362/294 |
| 2009/0262530 | A1 * | 10/2009 | Tickner et al. | 362/235 |

* cited by examiner

*Primary Examiner*—David V Bruce
(74) *Attorney, Agent, or Firm*—Chun-Ming Shih; HDLS IPR Services

(57) ABSTRACT

An LED lamp with heat dissipation mechanism having double heat pipe and tridimensional LEDs arrangement is disclosed. The lamp is composed of a heat-dissipation unit, a heat pipe whose one end is mounted on the heat-dissipation unit, a plurality of LED units mounted on an outer surface of the heat pipe, a fin module encompassing the heat-dissipation unit and a reflector mounted on a bottom of the heat-dissipation unit. The heat-dissipation unit has two basin-like casings. The LED units on the heat pipe are towards the reflector. Thus the reflector concentrates the light from the LED units.

6 Claims, 5 Drawing Sheets

LED LAMP WITH HEAT DISSIPATION MECHANISM AND MULTIPLE LIGHT EMITTING FACES

This application is a continuation-in-part of application Ser. No. 11/393,816, filed Mar. 31, 2006 now abandoned.

BACKGROUND OF THE INVENTION

1. Field of the Invention

The present invention relates to a lamp, especially to a lamp with heat dissipation mechanism.

2. Description of Prior Art

A light emitting diode (LED) is a solid-state semiconductor device, which has become popular or even necessary in our daily life. With the increase of power of the LEDs, more and more conventional lighting elements have been or will be replaced with the LEDs. However, the higher the power of the LEDs is, the more the heat generated from the LEDs is. Therefore, the high-power LEDs bring a serous problem, which is heat dissipation.

On the other hand, many manufactures of LED lamps always combine a plurality of LED units to constitute an LED lamp for increasing its brightness as a whole. The format of combination of LEDs will affect the brightness. Conventional lamps with multiple LED units usually arrange the LED units on a single plane. If the lamp requires more LED units, the plane being disposed the LED units must be planarly extended. This manner of arranging LED units can not achieve a great space-utilizing efficiency because of its planar combination. Furthermore, the combination of multiple LED units also has to match a structure of the heat dissipation.

SUMMARY OF THE INVENTION

An object of the present invention is to provide an LED lamp with heat dissipation mechanism and multiple light emitting faces, which has a heat dissipation mechanism with double heat pipe matching a tridimensional arrangement of LED units. Therefore, the space-utilizing efficiency of the LED lamps with multiple LED units can be increased effectively and the heat generated from the LED units also can be dissipated rapidly.

BRIEF DESCRIPTION OF DRAWING

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

Figure 1:
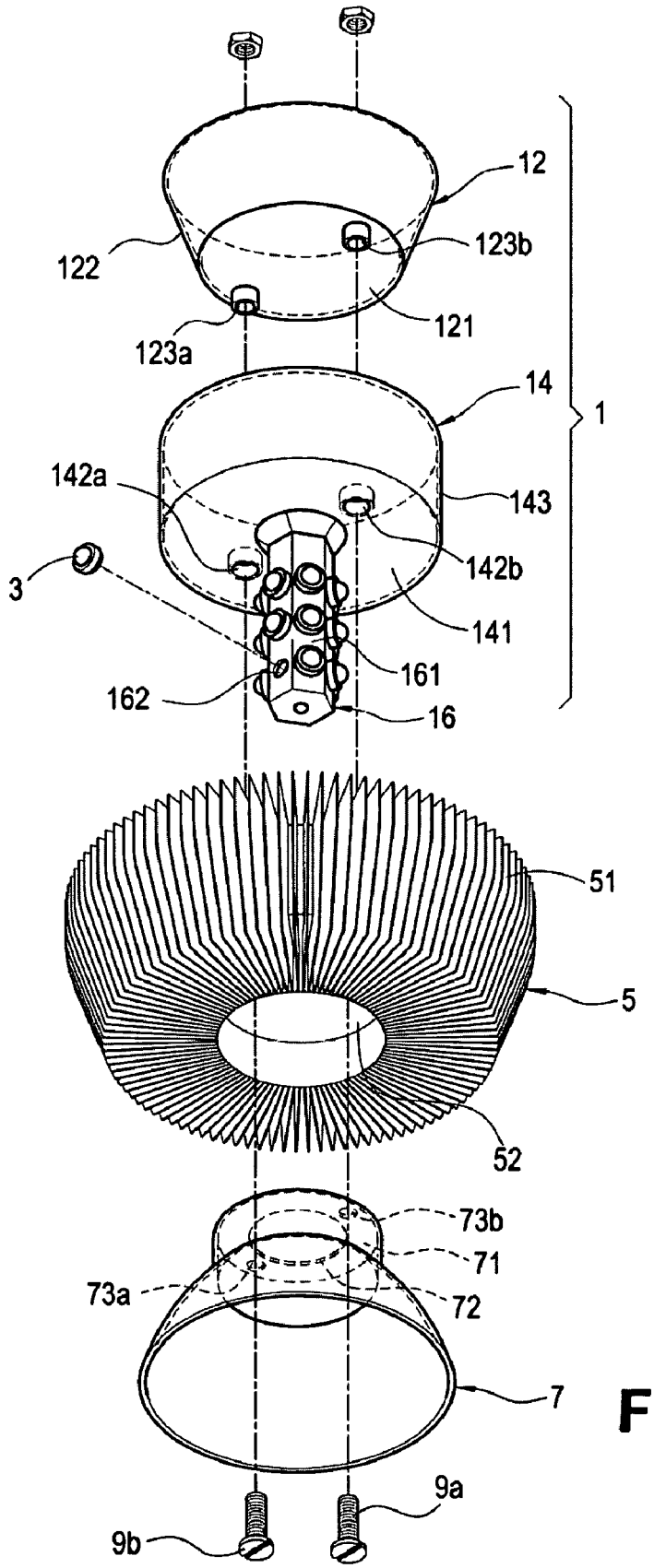
FIG. 1 shows an exploded view of the present invention.
Figure 2:
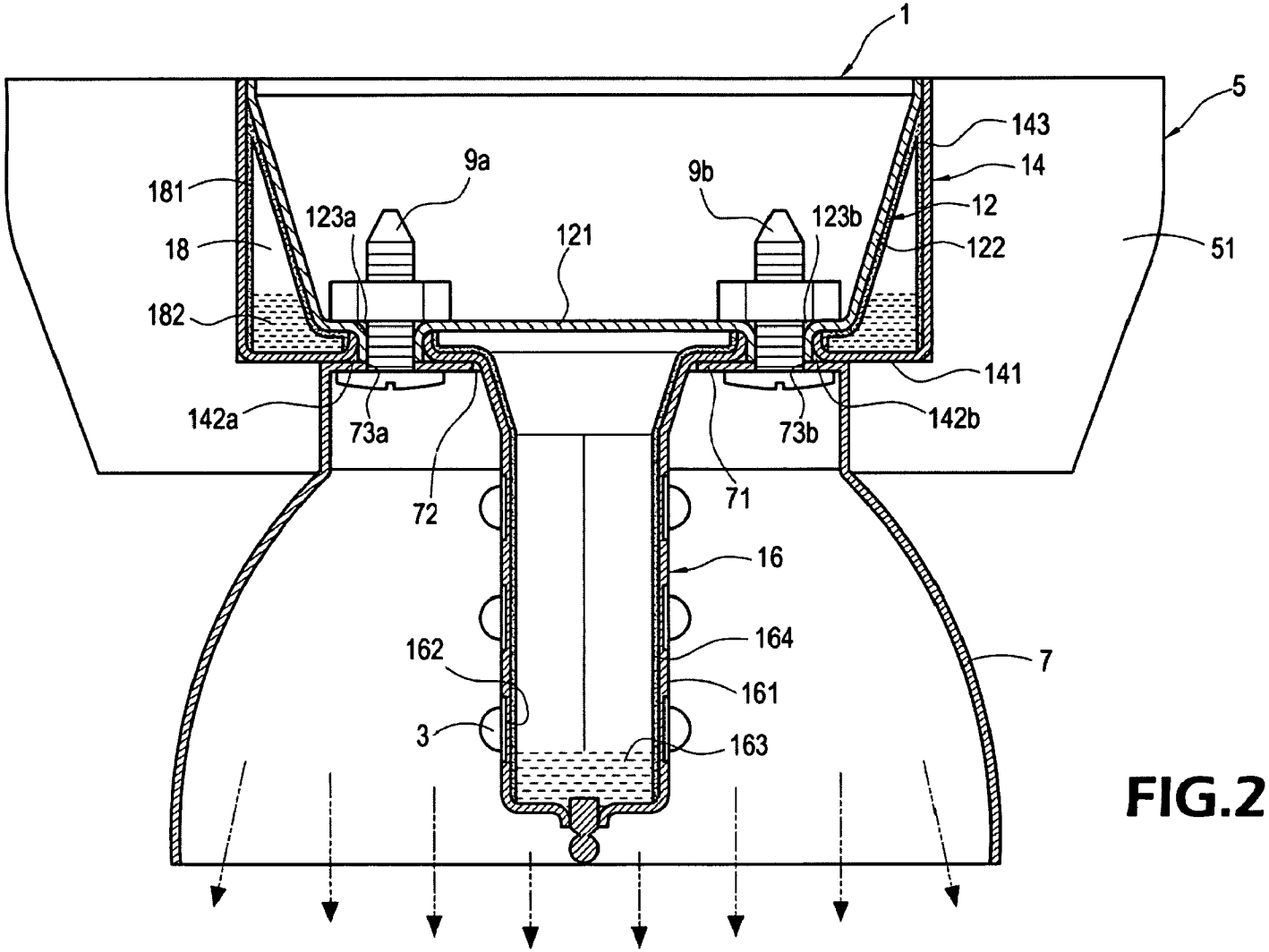
FIG. 2 shows the operation of the lamp according to the present invention.

FIG. 1 shows an exploded view of an LED lamp according to a preferred embodiment of the present invention. The LED lamp mainly includes a heat-dissipation unit 1, a plurality of LED units 3, a fin module 5 and a reflector 7. The heat-dissipation unit 1 is further composed of a first casing 12 with a basin shape, a second casing 14 accommodated in the first casing 12 and a heat pipe 16 connecting a bottom of the second casing 14. The first casing 12 has a base 121, whose diameter is smaller than an upper opening of the first casing 12. A side wall 122 of the first casing 12 is conoid. Two hole seats 123*a* and 123*b* are disposed on an outside of the base 121 and penetrate the base 121. The second casing 14 is of a basin shape with a vertical side wall 143. There are two holes 142*a*, 142*b* corresponding to the hole seats 123*a*, 123*b* on a bottom 141 of the second casing 14. When the first casing 12 is accommodated in the second casing 14, the hole seats 123*a*, 123*b* are in alignment with the holes 142*a*, 142*b*, respectively. An outer diameter of an upper opening of the second casing 14 is substantially equal to an inner diameter of the upper opening of the first casing 12. And the openings of the first and second casing 12 are coplanar when the two casings 12, 14 have been fastened. Therefore, an annulus space 18 is defined between the first casing 12 and the second casing 14, as shown in FIG. 2. A wick structure 181 and working fluid 182 are disposed in the annulus space 18 to form an annulus heat pipe.

Figure 3:
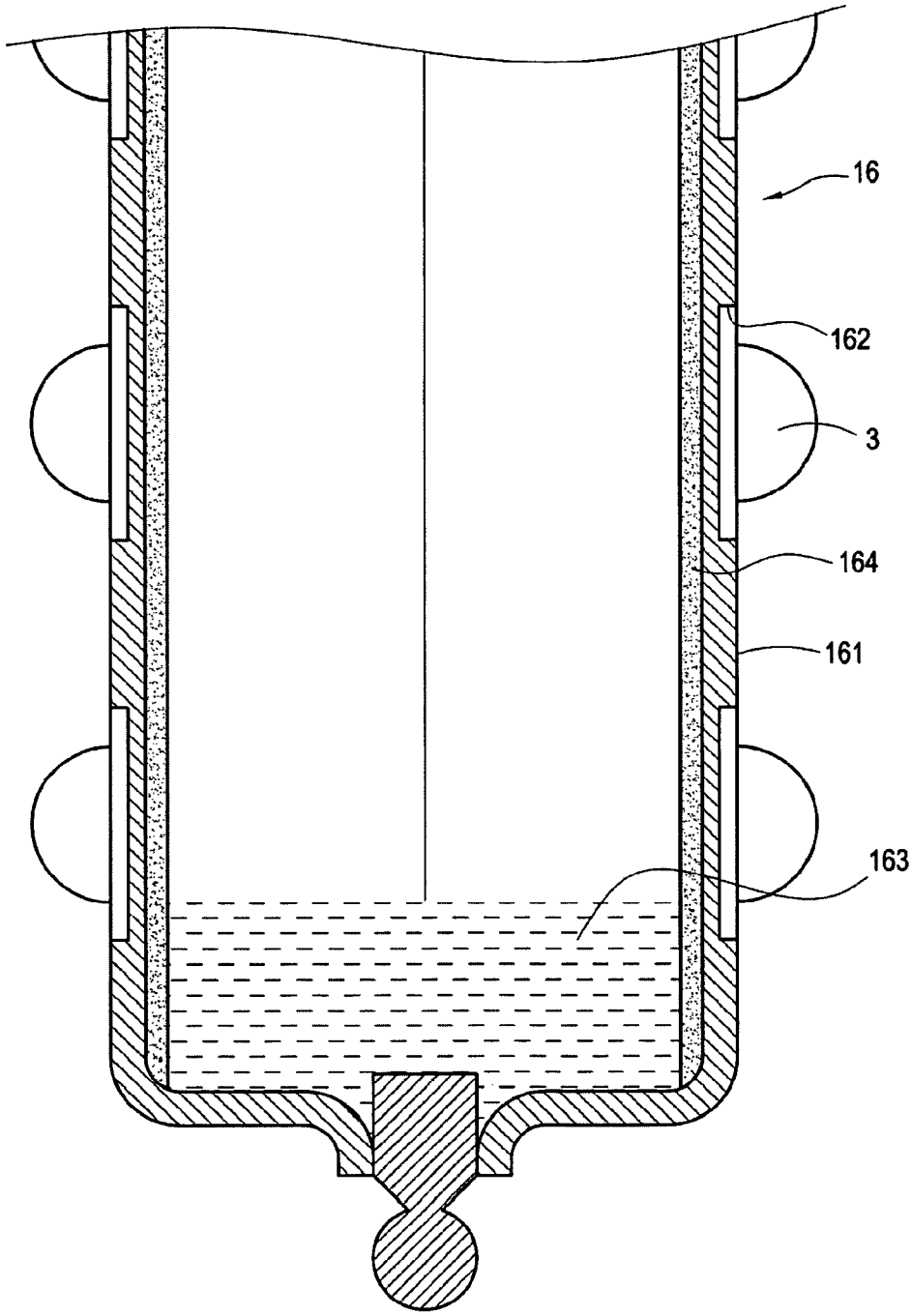
FIG. 3 shows a partially enlarged figure of the heat pipe.
Figure 4:
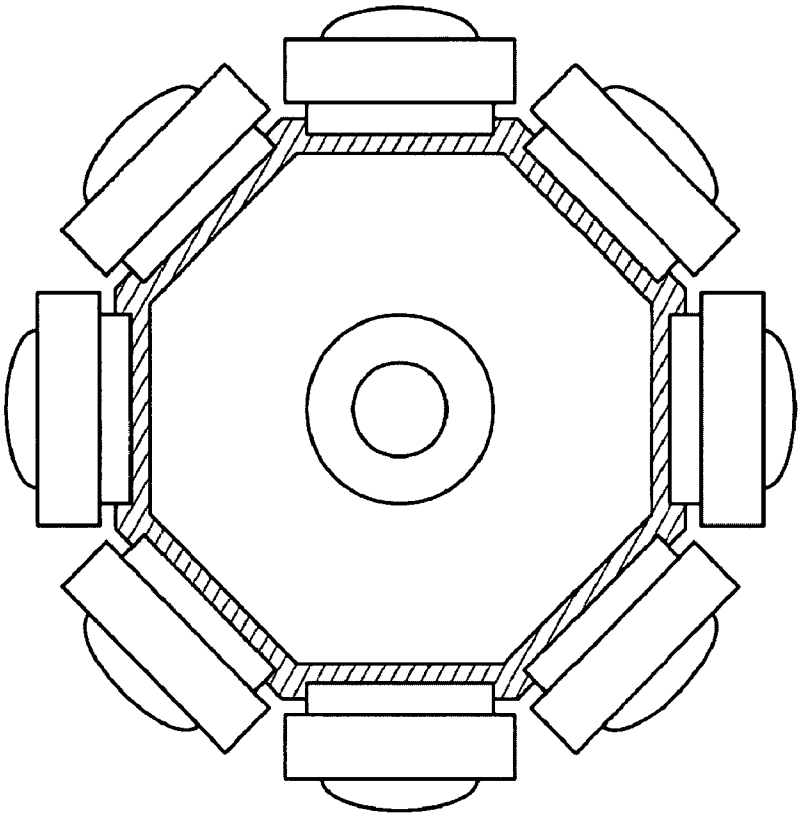
FIG. 4 shows the heat pipe according to another preferred embodiment of the present invention.
Figure 5:
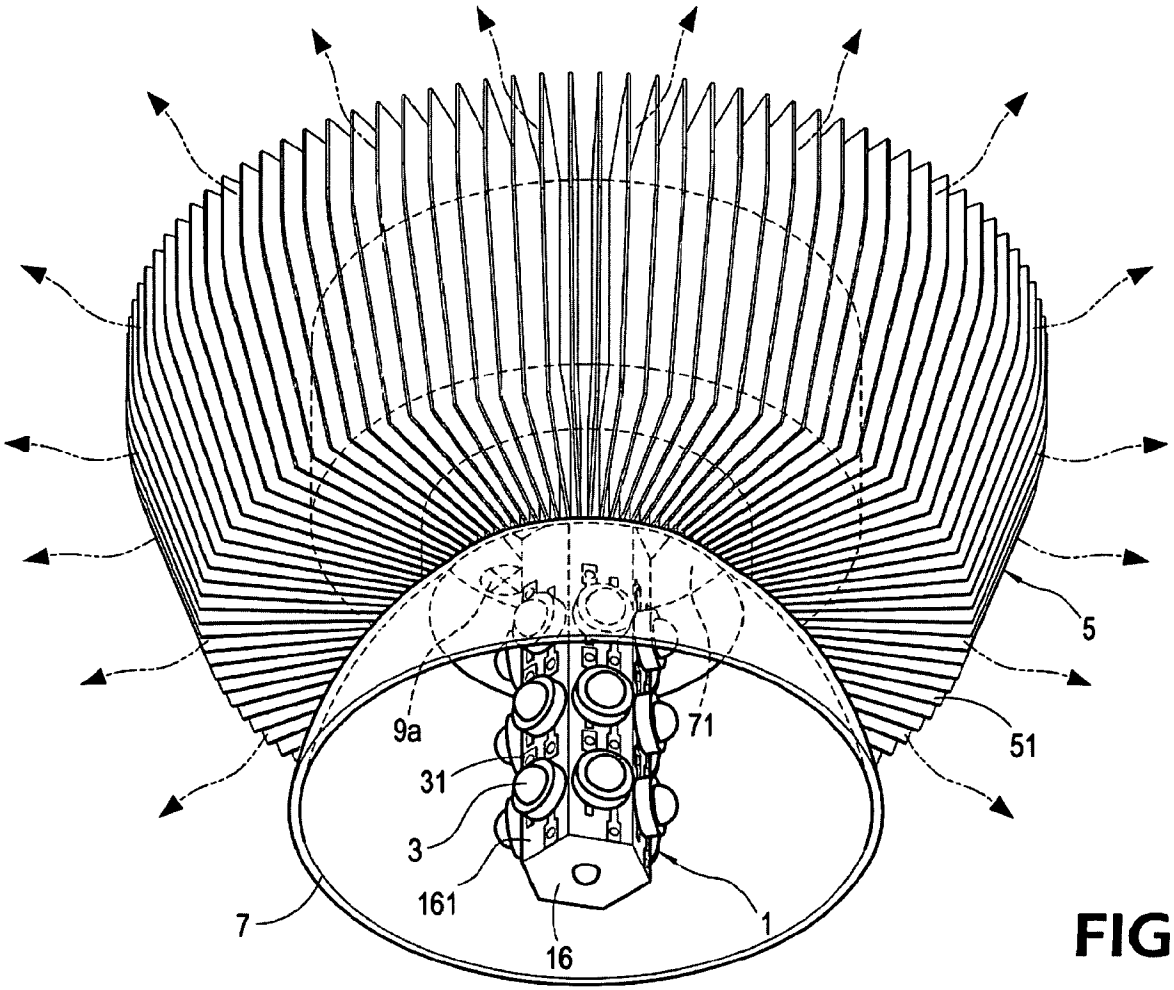
FIG. 5 shows a schematic view of heat dissipation in the lamp according to the present invention.

An end of the heat pipe 16 is axially mounted on the bottom 141 of the second casing 14. The heat pipe 16 is a sealed straight pipe containing working fluid 163 and a wick structure 164. The heat pipe 16 is thermal-conductively connected with the annulus space 18. The heat pipe 16 and the annulus space 18 are in vacuum state. The heat pipe 16 is formed as a polygonal cylinder such as a hexagonal cylinder shown in FIG. 1. However, a skilled person in the art must know that the shape of the polygonal cylinder can be changed, such as an octagonal cylinder shown in FIG. 4. In the preferred embodiment shown in FIG. 1, the heat pipe 16 has six symmetric planes 161. There are 3 pits 162 on each of the planes 161. Of course, any other number of pits is available. FIG. 3 shows a partially enlarged figure of the heat pipe 16, each of the pits 162 is assembled with a LED unit 3. The LED units 3 connect to a power source through the leads 31 thereof, where the leads 31 are extended along the planes 161, as shown in FIG. 5.

With reference back to FIG. 1, the fin module 5 is an annulus body composed of a plurality of fins 51 which are radially collocated. An accommodation space 52 is defined at center of the fin module 5 for encompassing the second casing 14 and a part of the reflector 7. The reflector 7 is like an inverse cup and arranged on the bottom of the second casing 14. An accommodation hole 72 is disposed at center of a top face 71 of the reflector 7 for allowing the heat pipe 16 to pass through, and two holes 73*a* and 73*b* are disposed on both sides of the accommodation hole 72. The positions of the through holes 73*a* and 73*b* are corresponding to the holes 142*a*, 142*b*, 73*a* and 73*b*, respectively. Therefore, the first casing 12, the second casing 14 and the reflector 7 can be fastened by screws 9*a*, 9*b*. Therefore, the heat pipe 16 is within the reflector 7 and the LED units 3 are towards the reflector 7.

FIG. 2 shows the operation of the LED lamp according to the present invention. After the LED units 3 light up, the light emitted from the LED units 3 is concentrated by the reflector 7 and then projects outward. Therefore, high brightness van be obtained. As shown in FIG. 5, the heat produced from the LED units 3 is absorbed by the heat pipe 16. Afterward the heat is conducted to the heat-dissipation unit 1 through the heat pipe 16 and the substantial heat pipe formed by the annulus space 18 and the wick structure 181 and working fluid 182 therein. The heat is then dissipated through the fin module 5.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An LED lamp, comprising a first casing being of a basin shape with a conoid side wall to form an opening larger than a bottom of the first casing;

a second casing being of a basin shape with a vertical side wall for receiving the first casing, wherein a sealed annulus space is defined between the first casing and the second casing, and a wick structure and working fluid are disposed in the annulus space to form as an annulus heat pipe;

a straight heat pipe, whose one end is mounted on a bottom of the second casing and thermal-conductively connected with the annulus space, wherein the heat pipe has a plurality of planes on outer face thereof; and LED units mounted on the planes of the heat pipe.

2. The LED lamp as in claim 1, wherein the heat pipe is a hexagonal cylinder.

3. The LED lamp as in claim 1, wherein the heat pipe is an octagonal cylinder.

4. The LED lamp as in claim 1, wherein the heat pipe contains wick structure and working fluid therein.

5. The LED lamp as in claim 1, further comprising a fin module encompassing the second casing.

6. The LED lamp as in claim 1, further comprising a reflector mounted on the bottom of the second casing and surrounding the heat pipe.

* * * * *